US008766896B2

(12) United States Patent
Shih et al.

(10) Patent No.: US 8,766,896 B2
(45) Date of Patent: Jul. 1, 2014

(54) DRIVING CIRCUIT AND LCD SYSTEM INCLUDING THE SAME

(75) Inventors: Jun-Ren Shih, Hsinchu (TW); Shin-Tai Lo, Miaoli (TW); Hung Li, Taipei (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 642 days.

(21) Appl. No.: 12/728,595

(22) Filed: Mar. 22, 2010

(65) Prior Publication Data

US 2011/0007052 A1 Jan. 13, 2011

(30) Foreign Application Priority Data

Jul. 9, 2009 (TW) ..... 98123183 A

(51) Int. Cl.
*G09G 3/36* (2006.01)

(52) U.S. Cl.
USPC ..... 345/96; 345/98; 345/99

(58) Field of Classification Search
USPC ..... 345/96, 98, 99
See application file for complete search history.

(56) References Cited

U.S. PATENT DOCUMENTS

| | | | | |
|---|---|---|---|---|
| 7,880,708 | B2 | 2/2011 | Chen | |
| 2006/0119596 | A1* | 6/2006 | Lin | 345/211 |
| 2007/0097152 | A1* | 5/2007 | Hagino et al. | 345/690 |

FOREIGN PATENT DOCUMENTS

| | | |
|---|---|---|
| TW | 200849211 | 12/2008 |

OTHER PUBLICATIONS

Chinese Office Action for Taiwan Application No. 098123183 dated May 2, 2013.

* cited by examiner

*Primary Examiner* — Jonathan Boyd

(57) ABSTRACT

A driving circuit for an LCD system is provided. The LCD system includes a common electrode, a display electrode, and a capacitor. An AC voltage output terminal of the driving circuit is coupled to the common electrode via the capacitor. The display electrode and a charging/discharging unit in the driving circuit are respectively coupled to the AC voltage output terminal through a switch. According to requirements to change the electrical polarity of the common electrode, a control unit in the driving circuit turns on/off the two switches respectively so as to charge or discharge the AC voltage output terminal.

18 Claims, 5 Drawing Sheets

DRIVING CIRCUIT AND LCD SYSTEM INCLUDING THE SAME

BACKGROUND OF THE INVENTION

1. Field of the Invention

The invention is related to display systems. In particular, the present invention relates to driving circuits for liquid crystal display (LCD) systems.

2. Description of the Prior Art

In recent years, LCDs are widely used in personal and commercial products. How to reduce the power consumption of an LCD and its driving circuits, so as to achieve the goal of reducing carbon emission or prolong the usable time of a portable device, has been an important issue for product designers.

As known by those skilled in the art, by providing different voltages to liquid crystal molecules, the rotational direction of liquid crystal molecules can be adjusted. The gray level of each pixel in an image to be displayed is correspondingly controlled. However, the rotational direction of a liquid crystal molecule cannot be fixed for a long time; otherwise the characteristic of the molecule will be destroyed and can no longer rotate corresponding to the voltage. Inevitably, in some practical situations, the image displayed on an LCD must be the same for a long time. To prevent liquid crystal molecules from being destroyed, the driving circuit of an LCD has to continuously adjust the voltages of the display electrodes and the common electrode disposed besides the liquid crystal molecules.

Generally, all the liquid crystal molecules in an LCD share the same common electrode, and the molecules in the same vertical line share one display electrode. When the voltage of a display electrode for a certain molecule is higher than the voltage of the common electrode, the molecule is called as having positive polarity. On the contrary, when the voltage of a display electrode for a certain molecule is lower than the voltage of the common electrode, the molecule is called as having negative polarity.

As lone as the voltage difference between the two electrodes is kept the same, no matter whether the display electrode or the common electrode has the higher voltage, the molecule is corresponding to the same gray level though the rotational directions under these two conditions are opposite to each other. Hence, the driving circuit can change the polarity of liquid crystal molecules between positive and negative alternatively, so as to keep the image the same and the liquid crystal molecules not being destroyed.

There are several ways to alternatively change the aforementioned polarity, for example, continuously changing the voltage of the common electrode. One commonality of these solutions is that the polarity of liquid crystal molecules is changed whenever the image data is changed. For an LCD having an image updating frequency equal to 60 Hz, the driving circuit of the LCD changes the polarity of all the liquid crystal molecules every 16 ms.

FIG. 1 shows an exemplary relationship between an LCD and its driving circuit. In this example, an image driving unit 16 in the driving circuit 10 provides driving signals corresponding to different gray levels to the display electrode 32. The AC voltage generating unit 12 and DC voltage generating unit 14 generates a periodical square wave for the common electrode 34.

As shown in FIG. 1, the AC voltage generating unit 12 is coupled to the common electrode 34 via a coupling capacitor $C_{AC}$. The coupling capacitor $C_{AC}$ is designed as much larger than the effective loading formed by the common electrode 34. Hence, even if the voltage of the output terminal A of the AC voltage generating unit 12 changes, the voltage difference across the coupling capacitor $C_{AC}$ roughly keeps unchanged. In other words, voltage variations occurring at terminal A will also make the voltage of terminal B, which is connected to the common electrode 34, change. For instance, assume the voltages of terminal A and terminal B are initially 4V and 1V, respectively. If the AC voltage generating unit 12 pulls the voltage of terminal A down to 0V, the voltage of terminal B will then become −3V.

In this example, the output voltage generated by the DC voltage generating unit 14 is kept as $V_{DC}$; the AC voltage generating unit 12 generates a periodical square wave changing alternatively between 0V and voltage $V_{CAC}$. Correspondingly, as shown in FIG. 2, the voltage of terminal B (i.e. the voltage provided from the driving circuit to the common electrode 34) will be a periodical square wave changing alternatively between voltages ($V_{DC}$□0.5*$V_{CAC}$) and ($V_{DC}$□0.5*$V_{CAC}$).

Practically, $V_{CAC}$ is typically twice the supply voltage of the DC voltage generating unit 14 and the image driving unit 16. Therefore, to periodically change the voltage at terminal A and the voltage of the common electrode 34 consumes much power.

SUMMARY OF THE INVENTION

To solve the aforementioned problem, the invention provides a driving circuit for an LCD system. By utilizing the techniques of charge sharing and pre-charging, the power consumption of changing the voltage of the common electrode can be effectively reduced.

One embodiment according to the invention is a driving circuit for an LCD system including a DC voltage supply unit, an image driving unit, an AC voltage output terminal, a charging/discharging switch, a charging/discharging unit, a charge sharing switch, and a control unit. The AC voltage output terminal is coupled to the common electrode via a coupling capacitor in the LCD system. The DC voltage supply unit is also coupled to the common electrode and supplies a DC voltage to the common electrode. The image driving unit is used for providing an image driving signal to the display electrode of the LCD system.

The charging/discharging unit is coupled to the AC voltage output terminal via the charging/discharging switch. When the charging/discharging switch is turned on, the charging/discharging unit charging or discharging the AC voltage output terminal. The charge sharing switch is coupled between the display electrode and the AC voltage output terminal. When the charge sharing switch is turned on, the display electrode and the AC voltage output terminal is electrically coupled to each other. The control unit is coupled to the charging/discharging switch and the charge sharing switch, respectively. Based on a requirement to change the electrical polarity of the common electrode, the control unit respectively controls the charging/discharging switch and the charge sharing switch.

In the driving circuit according to the invention, when the voltage of the AC voltage output terminal is required to be raised from low to high, the control unit can first turns on the charge sharing switch, so that the charge at the display electrode can be transferred to the AC voltage output terminal and preliminarily pulls high the voltage of the terminal. Then, the control can turns off the charge sharing switch and turns on the charging/discharging switch, so that the charging/discharging unit can finish the charging to the AC voltage output terminal.

As described above, the polarity of liquid crystal molecules is typically changed whenever the driving circuit changes the image. The driving circuit according to the invention can provide best power saving effect when the voltage of the AC voltage output terminal is pulling from low to high and, at the same time, the voltage of the display electrode is turning from high to low.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
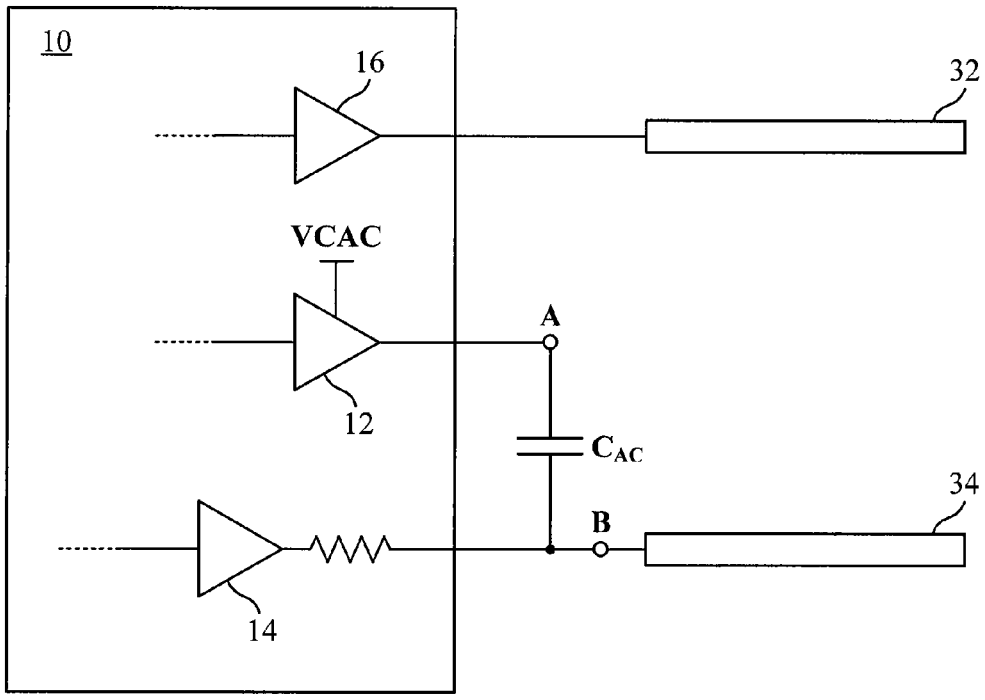
FIG. 1 (prior art)
FIG. 1 shows an exemplary relationship between an LCD and its driving circuit in prior arts.
Figure 2:
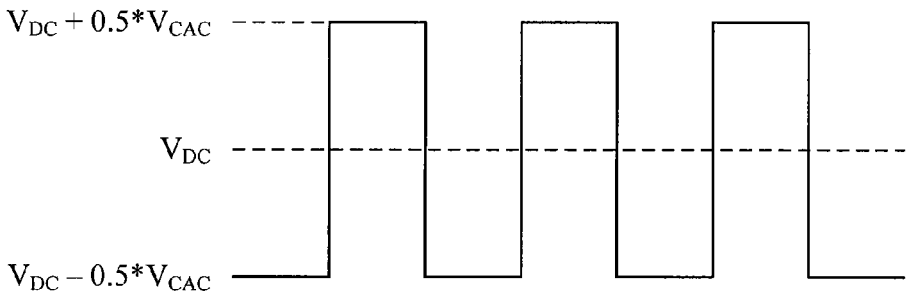
FIG. 2 (prior art)
FIG. 2 shows an exemplary voltage provided from the driving circuit to the common electrode in prior arts.
Figure 3:
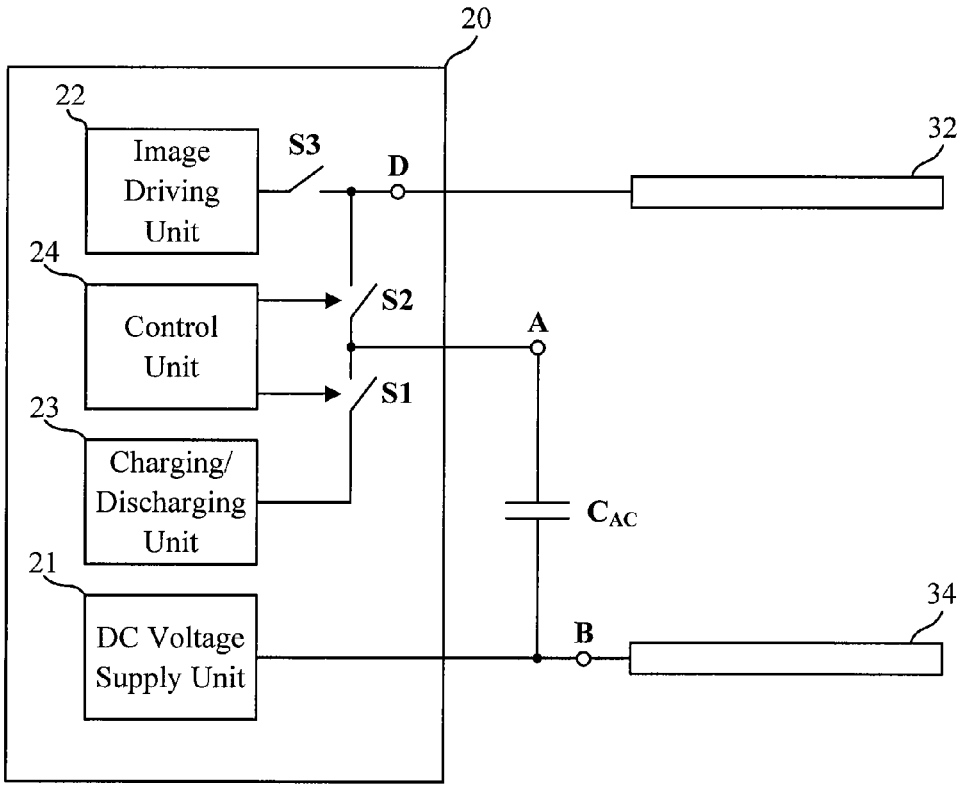
FIG. 3 illustrates the block diagram of the driving circuit and a corresponding LCD system in one embodiment according to the invention.

One embodiment according to the invention is a driving circuit. FIG. 3 illustrates the block diagram of the driving circuit and a corresponding LCD system. The driving circuit 20 includes a DC voltage supply unit 21, an image driving unit 22, an AC voltage output terminal A, a charging/discharging switch S1, a charging/discharging unit 23, a charge sharing switch S2, an image driving switch S3, and a control unit 24.

As shown in FIG. 3, the AC voltage output terminal A (hereinafter referred as terminal A) is coupled to the common electrode 34 via the coupling capacitor $C_{AC}$ in the LCD system. The DC voltage supply unit 21 is also connected to the common electrode 34 and provides the common electrode 34 a DC voltage $V_{DC}$. The image driving unit 22 is coupled to the display electrode 32 via the image driving switch S3 and used for providing an image driving signal to the display electrode 32. The display electrode 32 is coupled to terminal A via the charge sharing switch S2. When the charge sharing switch S2 is turned on, the display electrode 32 and terminal A are electrically connected with each other.

The charging/discharging unit 23 is coupled to terminal A via the charging/discharging switch S1. When the charging/discharging switch S1 is turned on, the charging/discharging unit 23 can charge or discharge terminal A. The control unit 24 is coupled to the charge sharing switch S2 and the charging/discharging switch S1, respectively. According to the polarity requirement for the common electrode 34, the control unit 24 controls the charge sharing switch S2 and the charging/discharging switch S1.

Figure 4:
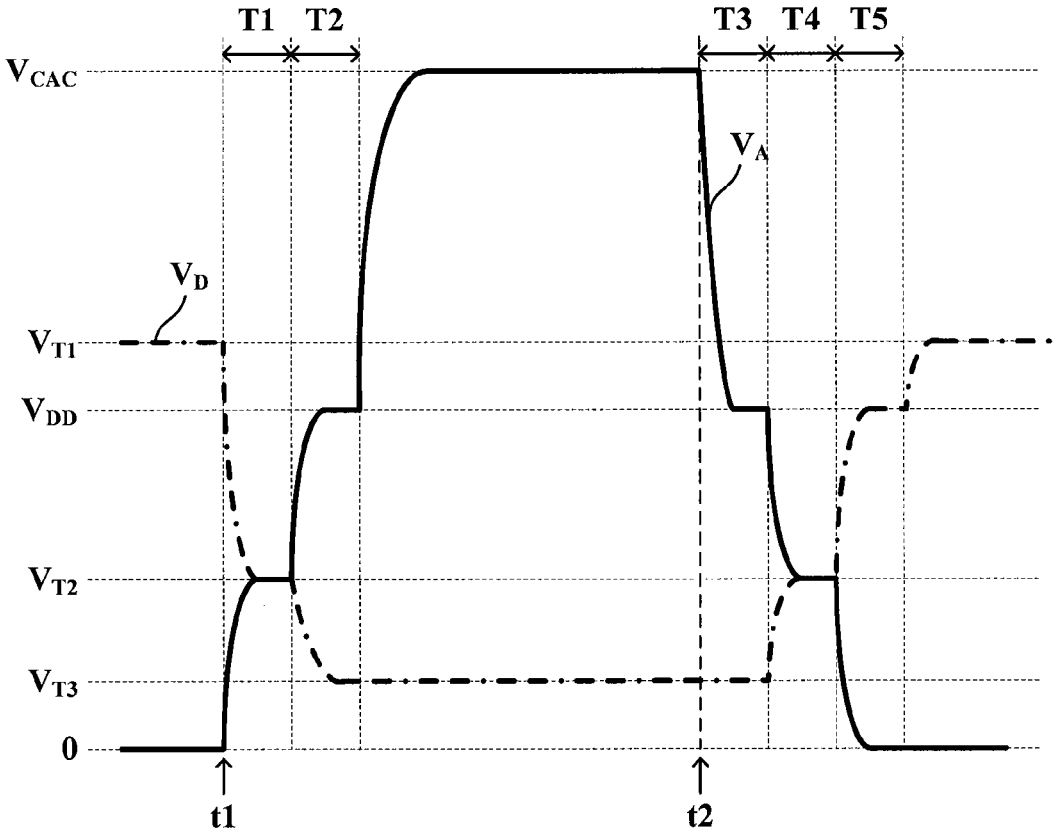
FIG. 4 shows an exemplary voltage/timing relationship of the voltages of terminal A and terminal D.

FIG. 4 shows an exemplary voltage/timing relationship of the voltage of terminal A ($V_A$) and the voltage of terminal D ($V_D$). In this example, at time instant t1, the control unit 24 turns on the charge sharing switch S2. At the same time, the control unit 24 turns off the charging/discharging switch S1 and the image driving switch S3. Accordingly, the display electrode 32 (i.e. terminal D) can share charge with terminal A; the voltages at these two terminals gradually become the same. When the polarity of the common electrode 34 is changing, the LCD system does not allow the driving circuit 20 to adjust the driving voltages provided to the pixels. Therefore, the charge sharing process does not affect the images displayed on the LCD.

As shown in FIG. 4, before time instant t1, $V_A$ is in a low-level status, and the voltage $V_D$ provided from the image driving unit 22 to the display electrode 32 is equal to $V_{T1}$. After deciding to change the polarity of the common electrode 34 from negative to positive at time instant t1, the control unit 24 turns on the charge sharing switch S2, turns off the charging/discharging switch S1, and turns off the image driving switch S3. Accordingly, the charge at terminal transfers to terminal A; $V_A$ is then preliminarily pulled high to $V_{T2}$.

In this example, after turning on the charge sharing switch S1 for a first predetermined duration T1, the control unit 24 turns off the charge sharing switch S2 and re-turns on the charging/discharging switch 51. The charging/discharging unit 23 then proceeds to finish the charging process for terminal A and pulls high $V_A$ to a high-level status, $V_{CAC}$. At the same time, the control unit 24 also re-turns on the image driving switch S3, so as to adjust the voltage $V_D$ provided from the image driving unit 22 to the display electrode 32 as $V_{T3}$.

During the above voltage transition, when $V_A$ is going to be pulled from low to high, the image driving unit 22 is going to pull $V_D$ from high to low (i.e. from $V_{T1}$ down to $V_{T3}$). Hence, the charge originally at terminal D can be provided to assist in pulling high $V_A$. Subsequently, the charging/discharging unit 23 only needs to pull $V_A$ from $V_{T2}$ to $V_{CAC}$. The process of charge sharing almost consumes no power. Compared with the AC voltage generating unit 12 that needs to independently pull the voltage of terminal A from 0 to $V_{CAC}$, the charging/discharging unit 23 according to the invention consumes less power.

Figure 5:
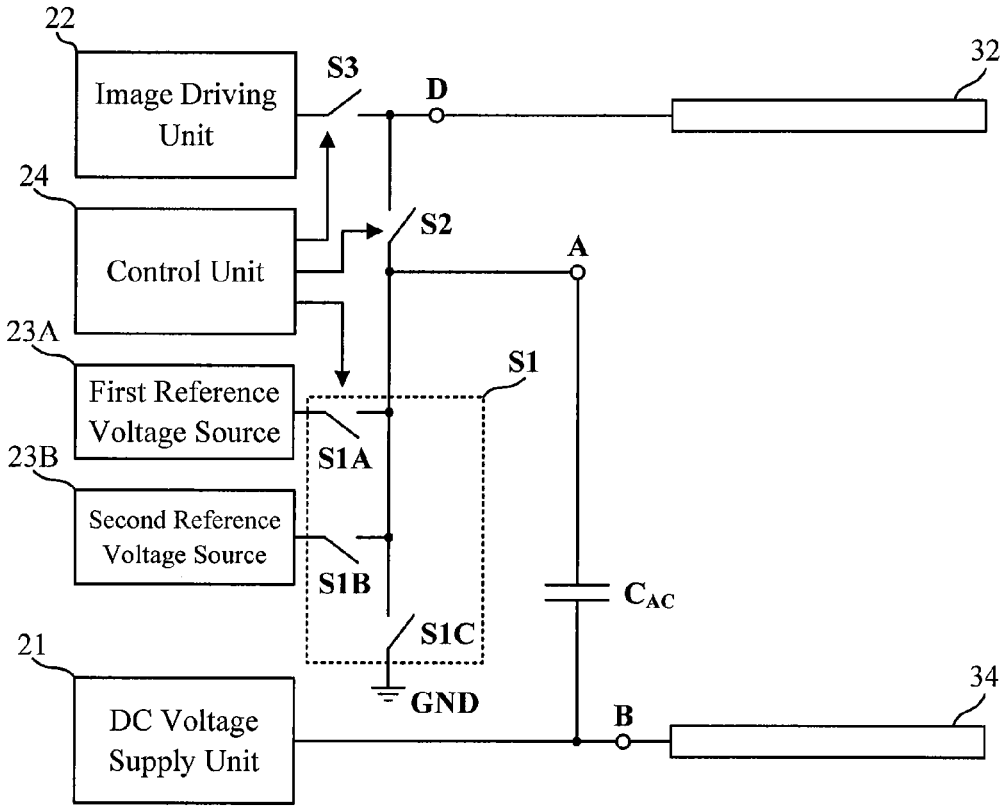
FIG. 5 and FIG. 6 illustrate detailed examples of the charging/discharging unit and the charging/discharging switch according to the invention.

Please refer to FIG. 5, which illustrates a detailed embodiment of the charging/discharging unit 23 and the charging/discharging switch S1. In this example, the charging/discharging unit 23 includes a first reference voltage source 23A and a second reference voltage source 23B. The first reference voltage source 23A is used for providing a DC voltage equal to $V_{DD}$. The second reference voltage source 23B is used for providing a DC voltage equal to $V_{CAC}$. $V_{DD}$ is the reference supply voltage adopted by the DC voltage supply unit 21 and the control unit 24. $V_{CAC}$ is higher than $V_{DD}$.

As shown in FIG. 5, the charging/discharging switch includes a first charging switch S1A and a second charging switch S1B. The first reference voltage source 23A is coupled to terminal A via the first charging switch S1A. The second reference voltage source 23B is coupled to terminal A via the second charging switch S1B.

According to the invention, after the duration T1 and the charge sharing switch S2 is turned off, the control unit 24 can first turn on the first charging switch S1A for a second predetermined duration T2, so as to let the first reference voltage source 23A preliminarily charge terminal A; $V_A$ is pulled high from $V_{T2}$ to $V_{DD}$. After the duration T2, the control unit 24 turns off the first charging switch S1A and turns on the second charging switch S1B, so as to let the second reference voltage source 23B pull $V_A$ from $V_{DD}$ to $V_{CAC}$. Because circuits adopting lower supply voltage generally consume less power, the proposed two-stage charging consumes less power than the condition only using second reference voltage source 23B. The total power consumption of the driving circuit according to the invention can accordingly be further reduced.

Practically, the driving circuit 20 according to the invention can also utilize the processes of charge sharing and preliminary discharging to pull $V_A$ from high to low. As shown in FIG. 5, the charging/discharging switch S1 also includes a discharging switch S1C. The charging/discharging unit 23 includes a ground terminal GND coupled to terminal A via the discharging switch S1C.

In this embodiment, after deciding to change the polarity of the common electrode 34 from positive to negative at time instant t2, the control unit 24 first turns on the first charging switch S1A, so as to let the first reference voltage source 23A preliminarily discharge terminal A; $V_A$ is pulled low from $V_{CAC}$ to $V_{DD}$. After the first charging switch S1A is turned on for a third predetermined duration T3, the control unit 24 turns off the first charging switch S1A and turns on the charging sharing switch S2. Terminal D can accordingly share charge with terminal A; the voltages at the two terminals gradually become the same. As shown in FIG. 4, during duration T4, $V_A$ is pulled down from $V_{DD}$ to $V_{T2}$, and $V_D$ is pulled high from $V_{T3}$ to $V_{T2}$.

After the charge sharing switch S2 is turned on for a fourth predetermined duration T4, the control unit 24 can turn off the charge sharing switch S2 and turn on the discharging switch S1C, so as to let the ground terminal pulls $V_A$ from $V_{T2}$ further to 0V. After turning off the charge sharing switch S2, the control unit 24 can re-turns on the image driving switch S3, so as to adjust the voltage $V_D$ provided from the image driving unit 22 to the display electrode 32 as $V_{T1}$.

Figure 6:
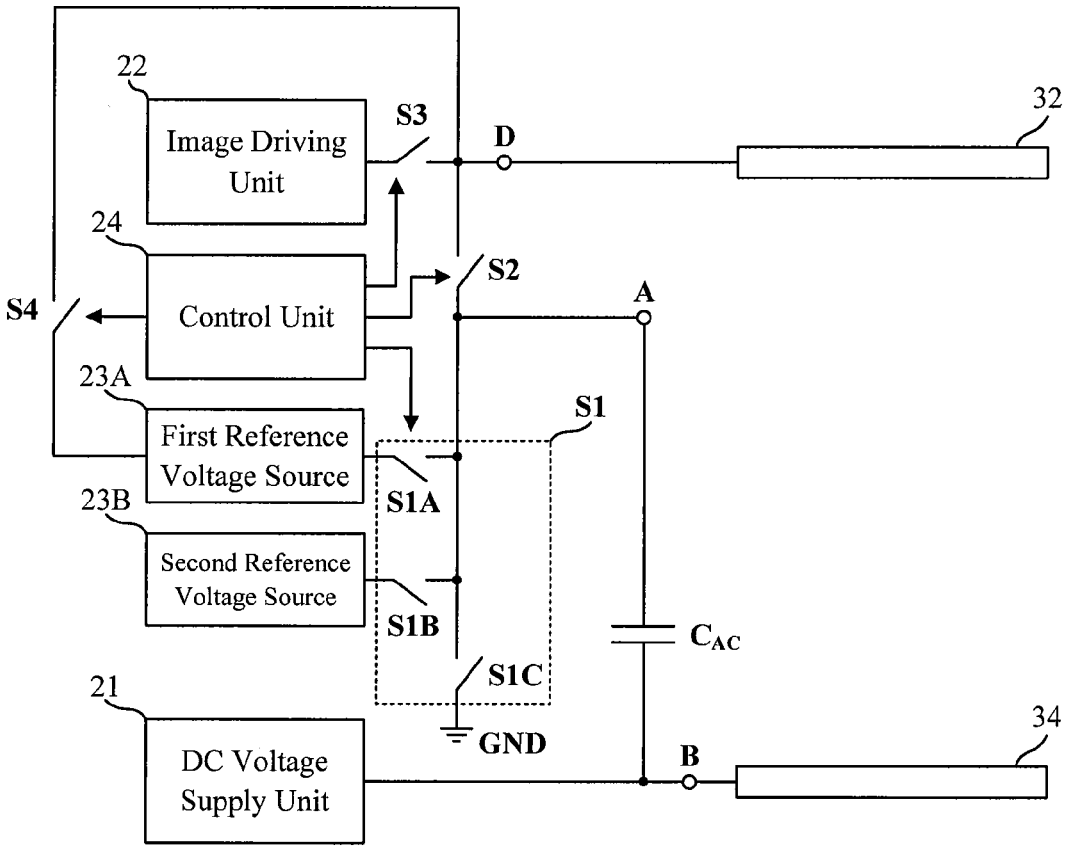

According to the invention, the circuit for preliminary charging terminal D can also be added. As shown in FIG. 6, a pre-charging switch S4 is coupled between the first reference voltage source 23A and terminal D. If the voltage to be provided from the image driving unit 22 to the display electrode 32 is higher than $V_{DD}$, after duration T4 is ended and before turning on the image driving switch S3, the control unit 24 can first turn on the pre-charging switch S4 for a fifth predetermined duration T5, so as to let the first reference voltage source 23A preliminarily pull $V_D$ up to $V_{DD}$. Then, the image driving unit 22 can proceed to pull $V_D$ high to $V_{T1}$. As described above, circuits adopting lower supply voltage generally consume less power. The proposed two-stage charging can reduce the total power consumption of the driving circuit.

In actual applications, the driving circuit can include plural image driving units 22 respectively corresponding to different vertical lines of liquid crystal molecules. According to the invention, the terminals between the image driving units and the display electrode 32 can all be coupled to terminal A via charge sharing switches and used as sources of providing charge.

Another embodiment according to the invention is an LCD system including all the components shown in FIG. 3. Its detailed operation is the same as the above embodiments and therefore not further described.

Because the process of charge sharing almost consumes no power, the driving circuit and LCD system according to the invention can effectively reduce the power needed for changing the polarity of the common electrode. With experiments and simulations, the inventors have proved the architecture according to the invention can considerably reduce power consumption compared with prior arts.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A driving circuit for an LCD system, the LCD system comprising a common electrode, a display electrode, and a coupling capacitor, the driving circuit comprising:

a DC voltage supply unit, coupled to the common electrode, for supplying a DC voltage to the common electrode;

an image driving unit, coupled to the display electrode, for providing an image driving signal to the display electrode;

an AC voltage output terminal coupled to the common electrode via the coupling capacitor;

a charging/discharging switch;

a charging/discharging unit coupled to the AC voltage output terminal via the charging/discharging switch, when the charging/discharging switch is turned on, the charging/discharging unit charging or discharging the AC voltage output terminal;

a charge sharing switch coupled between the display electrode and the AC voltage output terminal, when the charge sharing switch is turned on, the display electrode and the AC voltage output terminal being electrically coupled to each other; and a control unit, coupled to the charging/discharging switch and the charge sharing switch, for respectively controlling the charging/discharging switch and the charge sharing switch based on a requirement to change the electrical polarity of the common electrode, wherein when the voltage of the AC voltage output terminal is required to be raised from low to high, the control unit can first turn on the charge sharing switch to transfer a charge of the display electrode into the AC voltage output terminal and preliminarily pull high the voltage of the AC voltage output terminal to a first voltage level, the control unit secondly turns off the charge sharing switch and turns on the charging/discharging switch to charge the AC voltage output terminal to pull high the voltage of the AC voltage output terminal to a second voltage level, and the control unit thirdly controls the charge sharing switch and the charging/discharging switch to charge the AC voltage output terminal to pull high the voltage of the AC voltage output terminal to a third voltage level, wherein at the same time, the control unit pulls a voltage provided from the image driving unit to the display electrode from a fourth voltage level down to a fifth voltage level; wherein the third voltage level is larger than the second voltage level, the second voltage level is larger than the first voltage level, the fourth voltage level is between the second voltage level and the third voltage level, and the fifth voltage level is between 0 and the first voltage level.

2. The driving circuit of claim 1, wherein when the requirement indicates the electrical polarity of the common electrode is changing from negative to positive, the control unit turns on the charge sharing switch and turns off the charging/discharging switch.

3. The driving circuit of claim 2, wherein after turning on the charge sharing switch for a first predetermined duration, the control unit turns off the charge sharing switch and turns on the charging/discharging switch.

4. The driving circuit of claim 3, wherein the charging/discharging switch comprises a first charging switch, the charging/discharging unit comprises a first reference voltage source, the first reference voltage source is coupled to the AC voltage output terminal via the first charging switch, and after the charge sharing switch is turned off, the control unit turns on the first charging switch.

5. The driving circuit of claim 4, wherein the charging/discharging switch comprises a second charging switch, the charging/discharging unit comprises a second reference voltage source, the second reference voltage source is coupled to the AC voltage output terminal via the second charging switch, after turning on the first charging switch for a second predetermined duration, the control unit turns off the first charging switch and turns on the second charging switch, and a first reference voltage supplied by the first reference voltage source is lower than a second reference voltage supplied by the second reference voltage source.

6. The driving circuit of claim 1, wherein the charging/discharging switch comprises a first charging switch, the charging/discharging unit comprises a first reference voltage source, the first reference voltage source is coupled to the AC voltage output terminal via the first charging switch, and when the requirement indicates the electrical polarity of the common electrode is changing from positive to negative, the control unit first turns on the first charging switch.

7. The driving circuit of claim 6, wherein after the first charging switch is turned on for a third predetermined duration, the control unit turns off the first charging switch and turns on the charging sharing switch.

8. The driving circuit of claim 7, wherein the charging/discharging switch comprises a discharging switch, the charging/discharging unit comprises a ground terminal, the ground terminal is coupled to the AC voltage output terminal via the discharging switch, after the charge sharing switch is turned on for a fourth predetermined duration, the control unit turns off the charge sharing switch and turns on the discharging switch.

9. The driving circuit of claim 8, further comprising:

a pre-charging switch, coupled between the first reference voltage source and the display electrode, after the fourth predetermined duration is ended, the control unit turning on the pre-charging switch for a fifth predetermined duration.

10. An LCD system, comprising:

a common electrode;

a display electrode;

a coupling capacitor;

a DC voltage supply unit, coupled to the common electrode, for supplying a DC voltage to the common electrode;

an image driving unit, coupled to the display electrode, for providing an image driving signal to the display electrode;

an AC voltage output terminal coupled to the common electrode via the coupling capacitor;

a charging/discharging switch;

a charging/discharging unit coupled to the AC voltage output terminal via the charging/discharging switch, when the charging/discharging switch is turned on, the charging/discharging unit charging or discharging the AC voltage output terminal;

a charge sharing switch coupled between the display electrode and the AC voltage output terminal, when the charge sharing switch is turned on, the display electrode and the AC voltage output terminal being electrically coupled to each other; and a control unit, coupled to the charging/discharging switch and the charge sharing switch, for respectively controlling the charging/discharging switch and the charge sharing switch based on a requirement to change the electrical polarity of the common electrode, wherein when the voltage of the AC voltage output terminal is required to be raised from low to high, the control unit can first turn on the charge sharing switch to transfer a charge of the display electrode into the AC voltage output terminal and preliminarily pull high the voltage of the AC voltage output terminal to a first voltage level, the control unit secondly turns off the charge sharing switch and turns on the charging/discharging switch to charge the AC voltage output terminal to pull high the voltage of the AC voltage output terminal to a second voltage level, and the control unit thirdly controls the charge sharing switch and the charging/discharging switch to charge the AC voltage output terminal to pull high the voltage of the AC voltage output terminal to a third voltage level, wherein at the same time, the control unit pulls a voltage provided from the image driving unit to the display electrode from a fourth voltage level down to a fifth voltage level; wherein the third voltage level is larger than the second voltage level, the second voltage level is larger than the first voltage level, the fourth voltage level is between the second voltage level and the third voltage level, and the fifth voltage level is between 0 and the first voltage level.

11. The LCD system of claim 10, wherein when the requirement indicates the electrical polarity of the common electrode is changing from negative to positive, the control unit turns on the charge sharing switch and turns off the charging/discharging switch.

12. The LCD system of claim 11, wherein after turning on the charge sharing switch for a first predetermined duration, the control unit turns off the charge sharing switch and turns on the charging/discharging switch.

13. The LCD system of claim 12, wherein the charging/discharging switch comprises a first charging switch, the charging/discharging unit comprises a first reference voltage source, the first reference voltage source is coupled to the AC voltage output terminal via the first charging switch, and after the charge sharing switch is turned off, the control unit turns on the first charging switch.

14. The LCD system of claim 13, wherein the charging/discharging switch comprises a second charging switch, the charging/discharging unit comprises a second reference voltage source, the second reference voltage source is coupled to the AC voltage output terminal via the second charging switch, after turning on the first charging switch for a second predetermined duration, the control unit turns off the first charging switch and turns on the second charging switch, and a first reference voltage supplied by the first reference voltage source is lower than a second reference voltage supplied by the second reference voltage source.

15. The LCD system of claim 10, wherein the charging/discharging switch comprises a first charging switch, the charging/discharging unit comprises a first reference voltage source, the first reference voltage source is coupled to the AC voltage output terminal via the first charging switch, and when the requirement indicates the electrical polarity of the common electrode is changing from positive to negative, the control unit first turns on the first charging switch.

16. The LCD system of claim 15, wherein after the first charging switch is turned on for a third predetermined duration, the control unit turns off the first charging switch and turns on the charging sharing switch.

17. The LCD system of claim 16, wherein the charging/discharging switch comprises a discharging switch, the charging/discharging unit comprises a ground terminal, the ground terminal is coupled to the AC voltage output terminal via the discharging switch, after the charge sharing switch is turned on for a fourth predetermined duration, the control unit turns off the charge sharing switch and turns on the discharging switch.

18. The LCD system of claim 17, further comprising:

a pre-charging switch, coupled between the first reference voltage source and the display electrode, after the fourth predetermined duration is ended, the control unit turning on the pre-charging switch for a fifth predetermined duration.

* * * * *